US012460405B2

(12) United States Patent
Park et al.

(10) Patent No.: US 12,460,405 B2
(45) Date of Patent: Nov. 4, 2025

(54) METHOD FOR HORIZONTAL LEVELING COUPLING BETWEEN CONCRETE FOUNDATION AND WOODEN VERTICAL BEAMS

(71) Applicant: INDUSTRY-ACADEMIC COOPERATION FOUNDATION, DANKOOK UNIVERSITY, Yongin-si (KR)

(72) Inventors: Tae Won Park, Anyang-si (KR); Moo-Won Hur, Seoul (KR); Sang Hyun Lee, Yongin-si (KR)

(73) Assignee: INDUSTRY-ACADEMIC COOPERATION FOUNDATION, DANKOOK UNIVERSITY, Yongin-si (KR)

( * ) Notice: Subject to any disclaimer, the term of this patent is extended or adjusted under 35 U.S.C. 154(b) by 183 days.

(21) Appl. No.: 18/428,891

(22) Filed: Jan. 31, 2024

(65) Prior Publication Data

US 2025/0122715 A1 Apr. 17, 2025

(30) Foreign Application Priority Data

Oct. 12, 2023 (KR) ..... 10-2023-0136026
Dec. 29, 2023 (KR) ..... 10-2023-0196367

(51) Int. Cl.
*E04B 1/41* (2006.01)
*E04B 1/26* (2006.01)
(Continued)

(52) U.S. Cl.
CPC ..... *E04B 1/2604* (2013.01); *E04B 1/4157* (2013.01); *E04B 2001/2624* (2013.01);
(Continued)

(58) Field of Classification Search
None
See application file for complete search history.

(56) References Cited

U.S. PATENT DOCUMENTS 1,863,995 A * 6/1932 Ponstingl ..... A63H 33/082 403/295
4,987,708 A * 1/1991 Wilcox ..... E04B 1/98 52/126.6
(Continued)

FOREIGN PATENT DOCUMENTS

CN 107060108 A * 8/2017 ..... E04B 1/41
JP 10152894 A * 6/1998
(Continued)

*Primary Examiner* — Phi D Tran
(74) *Attorney, Agent, or Firm* — Fay Kaplun & Marcin, LLP

(57) ABSTRACT

A method is for horizontal leveling coupling between a concrete foundation and wooden vertical beams. The method includes (a) perforating n anchor holes in a predetermined position of the concrete foundation (where n is a natural number that is greater than or equal to 2); (b) installing a post-installed anchor in each of the n anchor holes; (c) coupling each of nuts to each thread-shaped anchor head located on an upper portion of the post-installed anchor, wherein the nuts are coupled so that upper surfaces of the nuts coincide with a reference surface X1; (d) preparing wooden vertical beams having lower surfaces in which insertion holes into which the nuts are inserted, are formed; (e) installing the wooden vertical beams by moving the wooden vertical beams in a horizontal direction so that the nuts are inserted into the insertion holes formed in the lower surfaces of the wooden vertical beams, wherein a movement direction of each of the wooden vertical beams is one of two or more movement directions; and (f) filling a space between lower surfaces of the concrete foundation and the nuts with a predetermined member.

10 Claims, 10 Drawing Sheets

(51) Int. Cl.
*E04B 1/48* (2006.01)
*E04B 5/23* (2006.01)

(52) U.S. Cl.
CPC ... *E04B 2001/264* (2013.01); *E04B 2001/266* (2013.01); *E04B 2001/2684* (2013.01); *E04B 1/41* (2013.01); *E04B 1/483* (2013.01); *E04B 2005/232* (2013.01); *E04B 2005/237* (2013.01)

(56) References Cited

U.S. PATENT DOCUMENTS

| | | | | | |
|---|---|---|---|---|---|
| 5,253,945 | A | * | 10/1993 | Hosokawa | E04C 3/38 403/258 |
| 2013/0028657 | A1 | * | 1/2013 | Kenho | E04B 1/2604 403/188 |
| 2015/0107183 | A1 | * | 4/2015 | Imai | E04B 1/4157 52/701 |
| 2022/0235566 | A1 | * | 7/2022 | Leonard | E04B 1/4157 |
| 2023/0078431 | A1 | * | 3/2023 | Sinclair | E04B 1/5831 52/169.9 |

FOREIGN PATENT DOCUMENTS

| | | | | | |
|---|---|---|---|---|---|
| JP | 2010077644 | A | * | 4/2010 | |
| JP | 2010203048 | A | * | 9/2010 | |
| KR | 200409430 | | | 2/2006 | |
| KR | 200409430 | Y1 | * | 2/2006 | E04H 12/2253 |
| KR | 100868932 | | | 11/2008 | |
| KR | 100868932 | B1 | * | 11/2008 | E04B 1/2604 |
| KR | 101237518 | B1 | * | 3/2013 | E04H 12/22 |
| KR | 20-2014-0001977 | U | | 4/2014 | |
| KR | 20180027739 | | | 3/2018 | |
| KR | 101920965 | B1 | * | 2/2019 | E04B 1/24 |
| KR | 101990065 | B1 | * | 6/2019 | E04B 1/21 |
| KR | 102227880 | | | 3/2021 | |
| KR | 20210055143 | | | 5/2021 | |
| KR | 10-2275170 | B1 | | 7/2021 | |
| KR | 10-2328651 | B1 | | 11/2021 | |
| KR | 10-2339681 | B1 | | 12/2021 | |
| KR | 20230000405 | U | * | 2/2023 | F16B 39/24 |
| KR | 102679931 | B1 | * | 7/2024 | E04C 3/36 |
| WO | WO-9406971 | A1 | * | 3/1994 | E04B 1/0007 |
| WO | WO-2004042172 | A1 | * | 5/2004 | E04B 2/80 |
| WO | WO-2021211256 | A1 | * | 10/2021 | E02D 27/425 |

* cited by examiner

METHOD FOR HORIZONTAL LEVELING COUPLING BETWEEN CONCRETE FOUNDATION AND WOODEN VERTICAL BEAMS

TECHNICAL FIELD

The present disclosure relates to an architectural field, and more particularly, to a method for architectural wooden construction.

BACKGROUND

Wooden buildings are buildings in which foundation structures for supporting buildings such as pillars, beams and the like are made of wood. Wooden buildings have low construction costs and high economic efficiency and are easy to be repaired, and the thermal conductivity of wood itself is low, and wooden buildings have high insulation and thus were widely used until recently.

Unlike in traditional wooden buildings, generally, a foundation of modern wooden buildings is made of concrete. Thus, wooden vertical beams are coupled to a concrete foundation. In this case, the wooden vertical beams and the concrete foundation having different types of materials need to be coupled to each other and thus, strong coupling of different types of materials performs an important role in the stability of buildings.

A common method of coupling is to install a post-installed anchor on a concrete foundation and to couple wooden vertical beams to the concrete foundation. As disclosed in Korean Utility-model Laid-open Publication No. 2014-0001977, a special type of a concrete foundation in which an anchor is buried in advance and a water discharge passage is installed at a concrete pouring stage, was proposed. All of these methods assume that horizontal leveling of the concrete foundation is done well.

However, in most buildings that use the concrete foundation, including wooden buildings, the concrete foundation is formed by forming a mold with the foundation level in a desired shape, pouring the concrete, and then curing the concrete, so that, in most cases, a horizontal surface of the concrete foundation is not perfect due to various reasons, such as uneven pouring of the concrete or water draining during the curing process. In other words, a horizontal leveling work is absolutely necessary in most cases.

The horizontal leveling work of the concrete foundation can be accomplished in a variety of ways. When a level difference is not large, the concrete foundation can be simply ground by using a tool, such as a grinder. Horizontal mortars, called self-leveling, are also used. Simply, in the case of RC buildings, a method for preventing uneven pouring by first inserting reinforcing bars with levels marked at regular intervals in the middle of the floor and then pouring them evenly based on this, is also used. However, this method cannot be used in wooden buildings that do not use reinforcing bars.

Horizontal leveling of the concrete foundation of wooden buildings is more important. In the case of RC buildings, load eccentricity can be somewhat prevented through the concrete during the formation of vertical beams such as pillars or load-bearing walls, whereas in wooden buildings where wooden vertical beams are erected, the load may be eccentric to the lowest vertical beam. In this case, the wooden vertical beams are easily deformed, and the wooden buildings become structurally unstable.

To prevent this, leveling members specialized for wooden buildings are developed and used. Korean Patent Registration No. 10-2275170, Korean Patent Registration No. 10-2328651, and Korean Patent Registration No. 10-2339681, which are patents filed by the present applicant, disclose plastic members inserted between a foundation and an understructure, through which horizontal leveling of upper surfaces of the foundation and the understructure is implemented. According to this method, the concrete foundation and the plastic members are strongly coupled to each other by using mortar, then the plastic members and a wooden understructure are coupled to each other by bolting, and then wooden vertical beams are coupled to the wooden understructure.

The described prior art has a limitation in that it requires the use of the wooden understructure. In addition, since three types of materials (concrete, plastic, and wood) are utilized, it is necessary to maintain strong individual coupling between different types of materials. In addition, it is necessary to manufacture the strength of the plastic members above a certain level to support the weight of the entire building, and it is also necessary to manage an air layer between the understructure and the plastic members.

Thus, there is a need for horizontal leveling of a concrete foundation and strong coupling between the concrete foundation and wooden vertical beams. When a method that satisfies these two needs at one time is developed, the complexity of construction can be reduced and simultaneously, the construction period can be reduced, and stable construction can be achieved.

(Patent Document 1) Korean Utility-model Laid-open Publication No. 2014-0001977
(Patent Document 2) Korean Patent No. 10-2275170
(Patent Document 3) Korean Patent No. 10-2328651
(Patent Document 4) Korean Patent No. 10-2339681

SUMMARY

The present disclosure relates to a method, wherein horizontal leveling of a concrete foundation is performed and simultaneously strong coupling between the concrete foundation and wooden vertical beams is performed.

According to an aspect of the present disclosure, there is provided a method for horizontal leveling coupling between a concrete foundation 30 and wooden vertical beams 10, the method including: (a) perforating n anchor holes 35 in a predetermined position of the concrete foundation 30 (where n is a natural number that is greater than or equal to 2); (b) installing a post-installed anchor 200 in each of the n anchor holes 35; (c) coupling each of nuts 240 to each thread-shaped anchor head 230 located on an upper portion of the post-installed anchor 200, wherein the nuts 240 are coupled so that upper surfaces of the nuts 240 coincide with a reference surface X1; (d) preparing wooden vertical beams 10 having lower surfaces in which insertion holes into which the nuts 240 are inserted, are formed; (e) installing the wooden vertical beams 10 by moving the wooden vertical beams 10 in a horizontal direction so that the nuts 240 are inserted into the insertion holes formed in the lower surfaces of the wooden vertical beams 10, wherein a movement direction of each of the wooden vertical beams 10 is one among two or more movement directions; and (f) filling a space between lower surfaces of the concrete foundation 30 and the nuts 240 with a predetermined member.

(f) may include (f1) filling a space between lower surfaces of the concrete foundation 30 and the nuts 240 with non-shrinking mortar.

(f) may further include (f2) filling a space between lower surfaces of the concrete foundation 30 and the nuts 240 with a wedge-shaped wooden washer plate 270.

The method may further include, after (c), (c1) cutting a portion A of the anchor head 230 protruding from upper sides of the upper surfaces of the nuts 240.

The nuts 240 may further include an epoxy bag 250 at upper sides of the nuts 240, and (e) may include (e1) installing the wooden vertical beams 10 by moving the wooden vertical beams 10 in the horizontal direction so that the nuts 240 are inserted into the insertion holes formed in the lower surfaces of the wooden vertical beams 10, wherein the epoxy bag 250 is unfolded and the insertion hole is filled with epoxy.

The method may further include, after (e1), (e2) filling the insertion hole with epoxy when the epoxy bag 250 is unfolded and further filling a space between the anchor hole 35 and the post-installed anchor 200 when the remaining epoxy descends along an anchor body 210 of the post-installed anchor 200.

The method may further include, after (b), (b1) preparing brackets 260 having ¬-shapes or [-shapes with lower surfaces in which holes having sizes that are greater than or equal to the anchor hole 35 are formed, and placing the brackets 260 on an upper portion of each of the anchor holes 35 so that the holes of the brackets 260 are placed in an upper portion of the anchor hole 35.

The nuts 240 may have hexagonal pyramid shapes and tapered shapes with widths decreasing downwards.

The insertion holes of the wooden vertical beams 10 may have tapered trapezoidal shapes with widths decreasing downwards.

The number of movement directions in which the wooden vertical beams 10 are installed, may be four, and the four movement directions may be perpendicular to one another on a horizontal plane.

According to the present disclosure, even when unevenness of a concrete foundation is severe, horizontal surfaces of wooden vertical beams are necessarily aligned so that the structural stability of wooden buildings is greatly increased.

Simultaneously, the horizontal leveling of the concrete foundation is sufficiently possible by aligning only lower surfaces of the already-coupled wooden vertical beams so that the horizontal leveling work is similarly convenient as using reinforcing bars with level in foundations of RC buildings and rather the horizontal leveling work is intuitive to workers. Thus, even unskilled workers can perform horizontal leveling conveniently.

Since coupling between the concrete foundation and wooden vertical beams and horizontal leveling of the concrete foundation are performed at one time, a construction period is reduced, and there is an economic efficiency. In particular, insertion holes of the wooden vertical beams can be manufactured in a factory and thus, this is more economical.

By adopting an epoxy bag, coupling strength between the wooden vertical beams and a post-installed anchor can be improved. By increasing the amount of epoxy contained in the epoxy bag, epoxy flows downward along an anchor body so that coupling strength between the post-installed anchor and the concrete foundation can also be improved.

By removing an anchor head protruding from an upper side of a nut, processing difficulty of the wooden vertical beams can be reduced. Alternatively, anchor head holes are prepared in the wooden vertical beams in advance through factory processing and then a process of removing the anchor head is omitted on a site so that a construction period can also be reduced.

DETAILED DESCRIPTION

Figure 1:
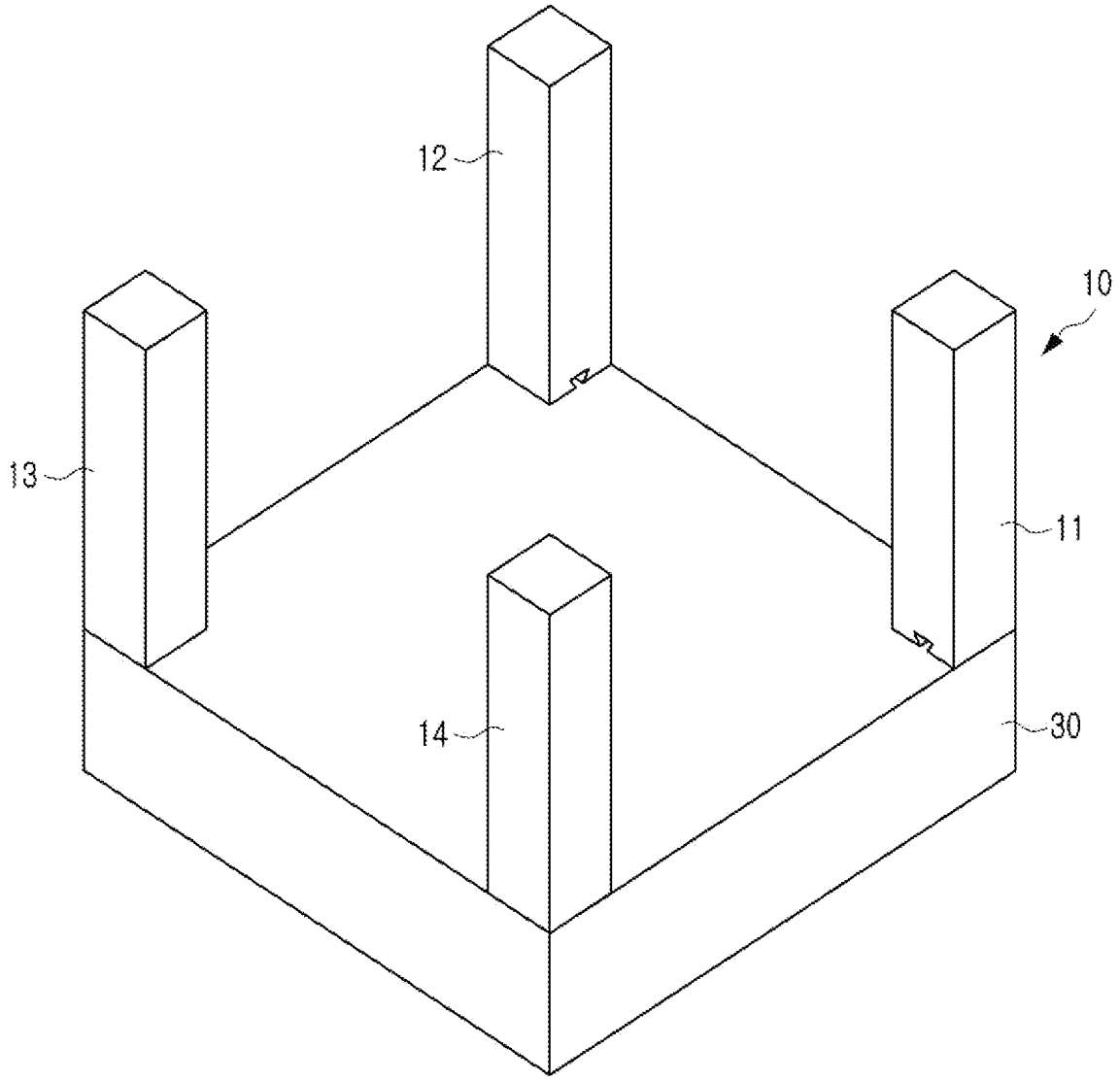
FIGS. 1 and 2 illustrate wooden vertical beams and a concrete foundation that are coupled to one another according to a method of the present disclosure.

Hereinafter, some embodiments of the present disclosure will be described in detail through exemplary drawings. When adding reference numerals to components in each drawing, it should be noted that the same components have the same reference numerals as much as possible even if they are shown in different drawings. Also, in describing the present disclosure, if it is determined that a detailed description of a related known configuration or function may obscure the gist of the present disclosure, the detailed description will be omitted.

In describing the components of the embodiment according to the present disclosure, symbols, such as first, second, i), ii), a), and b), and the like may be used. These symbols are only used to distinguish the component from other components, and the nature, sequence, or order of the component is not limited by the symbols. In the specification, when a part is said to 'include' or 'comprise' a certain element, this means that it does not exclude other elements, but may further include other elements, unless explicitly stated to the contrary.

In the present disclosure, the sizes of wooden vertical beams 10 and a post-installed anchor 200 are illustrated regardless of their actual sizes, and it will be noted that, for convenience of explanation, some configurations are exaggeratedly or understatedly illustrated.

Description of the Concept of the Present Disclosure

The present disclosure proposes a method, whereby horizontal leveling of a concrete foundation 30 is performed by coupling wooden vertical beams 10 to the concrete foundation 30 in which horizontal leveling is not performed and which is not level and uneven, first and then by performing leveling by aligning a horizontal surface of the concrete foundation 30 based on the wooden vertical beams 10 (more precisely, horizontal leveling based on an upper surface of a nut 240 inserted into the wooden vertical beams 10 to a uniform height) and by filling a space between lower surfaces of the wooden vertical beams 10 and an upper surface of the concrete foundation 30 that is horizontally leveled with non-shrinking mortar.

That is, the present disclosure proposes a method, whereby coupling between the concrete foundation 30 and the wooden vertical beams 10 and horizontal leveling of the concrete foundation 30 are performed at one time, and proposes a method, whereby the wooden vertical beams 10 are installed so that horizontal surfaces of the wooden vertical beams 10 are aligned and then horizontal leveling of the concrete foundation 30 is performed, contrary to a method according to the related art, whereby horizontal leveling of the concrete foundation 30 is first performed and then the wooden vertical beams 10 are coupled to the concrete foundation 30 that is horizontally leveled.

Since the horizontal surfaces of the wooden vertical beams 10 are aligned by using this method even if the concrete foundation 30 is uneven, the structural stability of a wooden building is greatly increased, and the difficulty of horizontal leveling of the concrete foundation 30 is greatly lowered. Since two functions are performed at one time, a construction period is reduced, and this has excellent economic efficiency.

Hereinafter, the method will be described in detail with reference to the drawings.

Description of a First Embodiment

A coupling assembly according to a first embodiment of the present disclosure will be described with reference to FIGS. 1 through 7.

Figure 2:
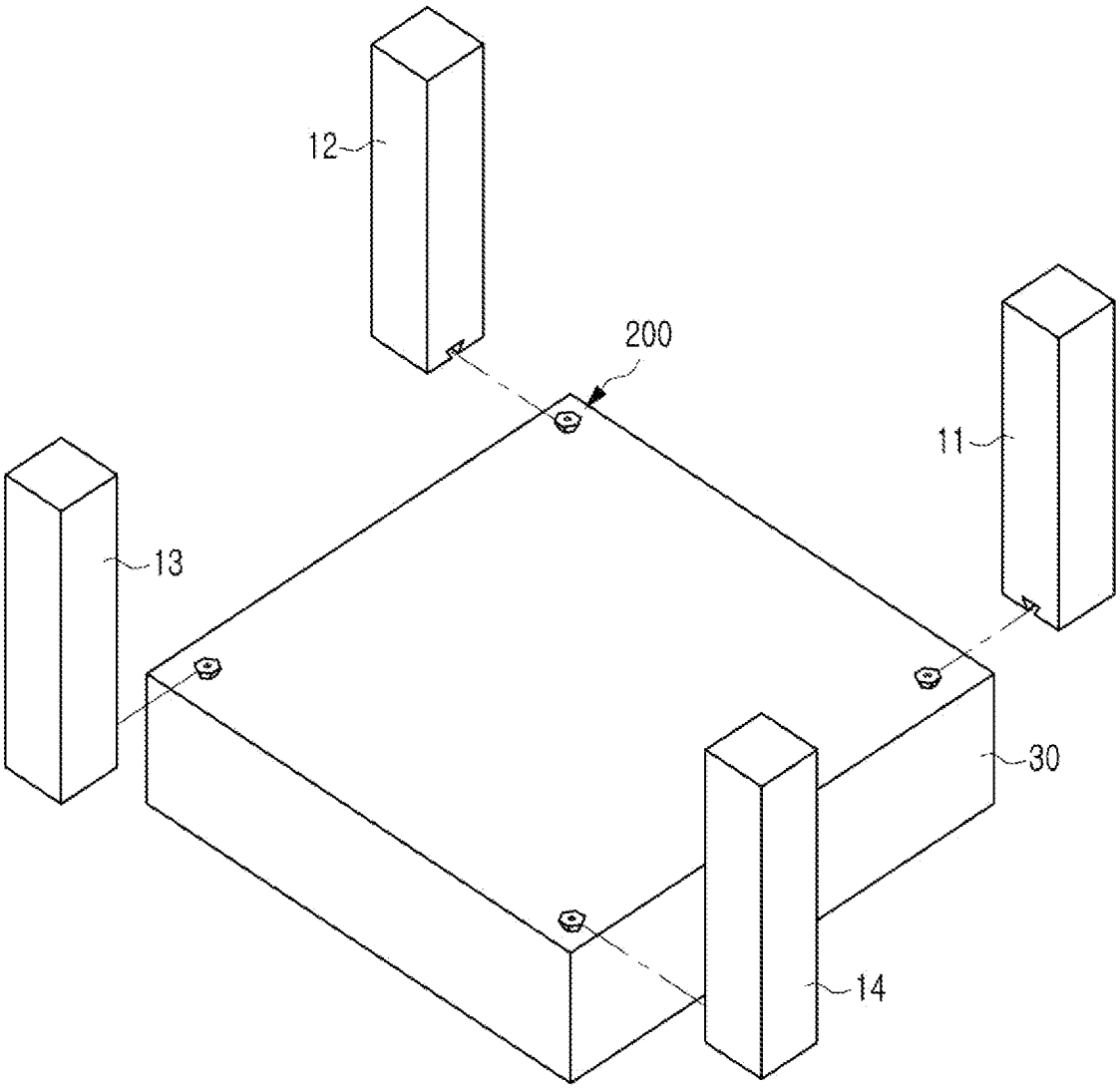

Wooden vertical beams 10 are a foundation structure of a building and may include pillars or load-bearing walls, may be portions for supporting the load of the building, and may also be portions such as curtain walls, which do not support the load of the building and for which precise vertical construction is important (see FIGS. 1 and 2).

The number of wooden vertical beams 10 is not limited but may be two or more in a general wooden building. Hereinafter, the number of wooden vertical beams 10 is referred to as n (where n is a natural number that is greater than or equal to 2), and in the drawings, the wooden vertical beams 10 include first wooden beams 11 through fourth wooden beams 14 but the number of the wooden vertical beams 10 may be properly changed according to the shape or structure of the building.

Figure 3:
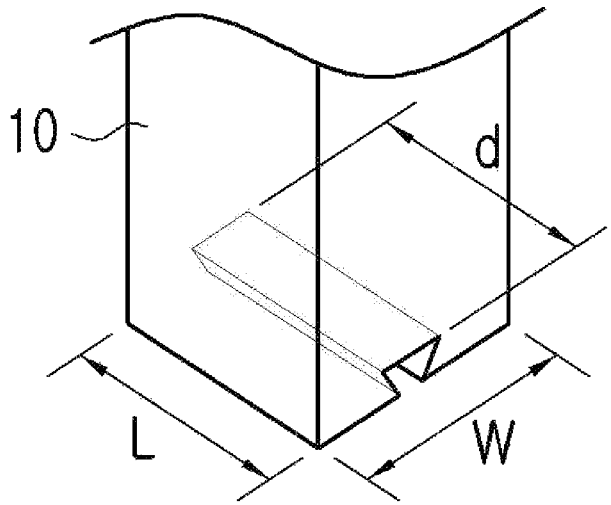
FIG. 3 is an enlarged view of lower portions of the wooden vertical beams used in the method of the present disclosure.

Insertion holes to be combined with the post-installed anchor 200 are formed in one surface of lower ends of the wooden vertical beams 10 (see FIG. 3). The insertion holes are recessed from one surface of the lower ends of the wooden vertical beams 10 inwards by a predetermined depth d. In this case, the depth d of the insertion hole may be less than a length L of the wooden vertical beams 10 or a width W of the wooden vertical beams 10, and preferably, the depth d of the insertion hole may be half the length L of the wooden vertical beams 10. Thus, when a nut 240 of the post-installed anchor 200 is fully inserted into the insertion hole, the nut 240 may be arranged in the center of the inside of the wooden vertical beams 10, and eccentricity does not occur, and this is stable.

In a predetermined embodiment, a long anchor head hole (not shown) may be further formed in a vertical direction in which the anchor head 230 is inserted into an upper side of the insertion hole of the wooden vertical beams 10. This is utilized in an embodiment in which the protruding portion of the anchor head 230 is not removed.

Meanwhile, the insertion holes may be formed to be open so that the wooden vertical beams 10 direct their movement direction. The movement direction of the wooden vertical beams 10 will be described below.

The concrete foundation 30 is a foundation portion of a wooden building constructed by the wooden vertical beams 10. As will be described below, an anchor hole 35 into which the post-installed anchor 200 is inserted, is perforated in the concrete foundation 30.

Figure 4:
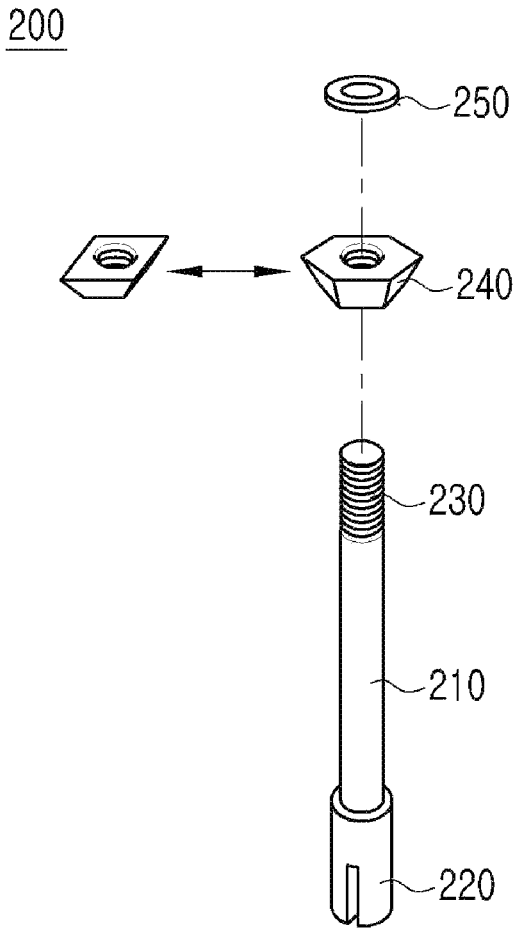
FIG. 4 illustrates a post-installed anchor used in the method of the present disclosure.

The post-installed anchor 200 is a type of a concrete anchor and is an anchor installed after a concrete has cured and hardened (see FIG. 4). Compared to chemical anchors, the construction period of the post-installed anchor 200 is shorter and the manufacturing and construction costs are lower, so that the overall construction period is reduced and the overall cost is reduced when constructing a wooden building. In addition, the sizes of holes into which the post-installed anchor is inserted are also smaller than the sizes of the chemical anchor, and tilting of the anchor can be prevented, which has the effect of improving safety.

The post-installed anchor 200 includes an anchor body 210, a sleeve 220, which is installed at a lower end of the anchor body 210 and in which, when the anchor hole 35 is inserted, the sleeve 220 expands so that the coupling strength is increased, and an anchor head 230, which is installed at an upper portion of the anchor body 210 and in which a thread is formed.

The nut 240 may be inserted into the thread-shaped anchor head 230.

The shape of the nut 240 is not limited, and as the wooden vertical beams 10 are moved in a horizontal direction, preferably, the nut 240 may be inserted into the insertion hole in the horizontal direction. For example, as shown in FIG. 3, when the width of the insertion hole of the wooden vertical beams 10 decreases downwards, the nut 240 may have a trapezoidal shape with a width decreasing downwards. In this case, preferably, the height of the insertion hole of the wooden vertical beams 10 and the height of the nut 240 may correspond to each other.

In an embodiment, the nut 240 may have a trapezoidal shape with the width decreasing downwards, but may also have a hexagonal pyramid shape that is hexagonal on a plane. When the insertion hole of the wooden vertical beams 10 has a shape of a square pyramid, as shown in FIG. 3, when the nut 240 is inserted into the insertion hole of the wooden vertical beams 10, a space is created between the square pyramid and the hexagonal pyramid. A corresponding space facilitates the movement of the wooden vertical beams 10, but the strength may be lowered by the space, so that it is preferable in terms of strength to fill the space with an adhesive, such as epoxy. To this end, an epoxy bag 250 may also be provided on the top of the nut 240.

The epoxy bag 250 includes an outer shell that can be easily broken by impact, and includes an adhesive, such as epoxy within the outer shell. As the wooden vertical beams 10 are moved and the nut 240 is inserted into the insertion hole of the wooden vertical beams 10, the outer shell of the epoxy bag 250 is unfolded, and the epoxy inside flows out. The epoxy first fills the space between the insertion hole of the wooden vertical beams 10 and the nut 240, thereby increasing coupling strength.

The amount of the epoxy included in the epoxy bag 250 may be set to correspond to the volume of the space between the insertion hole of the wooden vertical beams 10 and the nut 240. In another embodiment, the amount of the epoxy contained in the epoxy bag 250 may be set to be greater than the volume of the space between the insertion hole of the wooden vertical beams 10 and the nut 240. In this case, the epoxy fully fills the space between the insertion hole of the wooden vertical beams 10 and the nut 240 and then flows downwards along the anchor body 210, which may fill the space between the post-installed anchor 200 and the anchor hole 35 (see FIG. 7) so that strength between the post-installed anchor 200 and the concrete foundation 30 may be improved.

In another embodiment, the nut 240 may have not a hexagonal pyramid shape but a square pyramid shape (left side of FIG. 4). That is, the shape and the size of the insertion hole of the wooden vertical beams 10 and the shape and the size of the nut 240 are substantially the same so that the nut 240 may also be inserted without the remaining space in the insertion hole. Even in this case, the epoxy bag 250 may also be provided. The epoxy does not fill the space between the insertion hole of the wooden vertical beams 10 and the nut 240 but flows along the anchor body 210 and fills the space between the post-installed anchor 200 and the anchor hole 35.

A coupling method according to the first embodiment will be described in more detail with further reference to FIG. 5.

After determining the position of the concrete foundation 30 to which n wooden vertical beams 10 need to be coupled, in advance, n anchor holes 35 are perforated (operation S510). The size of each of the anchor holes 35 is a size at which the post-installed anchor 200 is inserted into each anchor hole 35 and fixed thereto. Additionally, the depth of each anchor hole 35 is a length at which an anchor head 230 protrudes from the concrete foundation 30 after the post-installed anchor 200 is inserted into each anchor hole 35.

Figure 6:
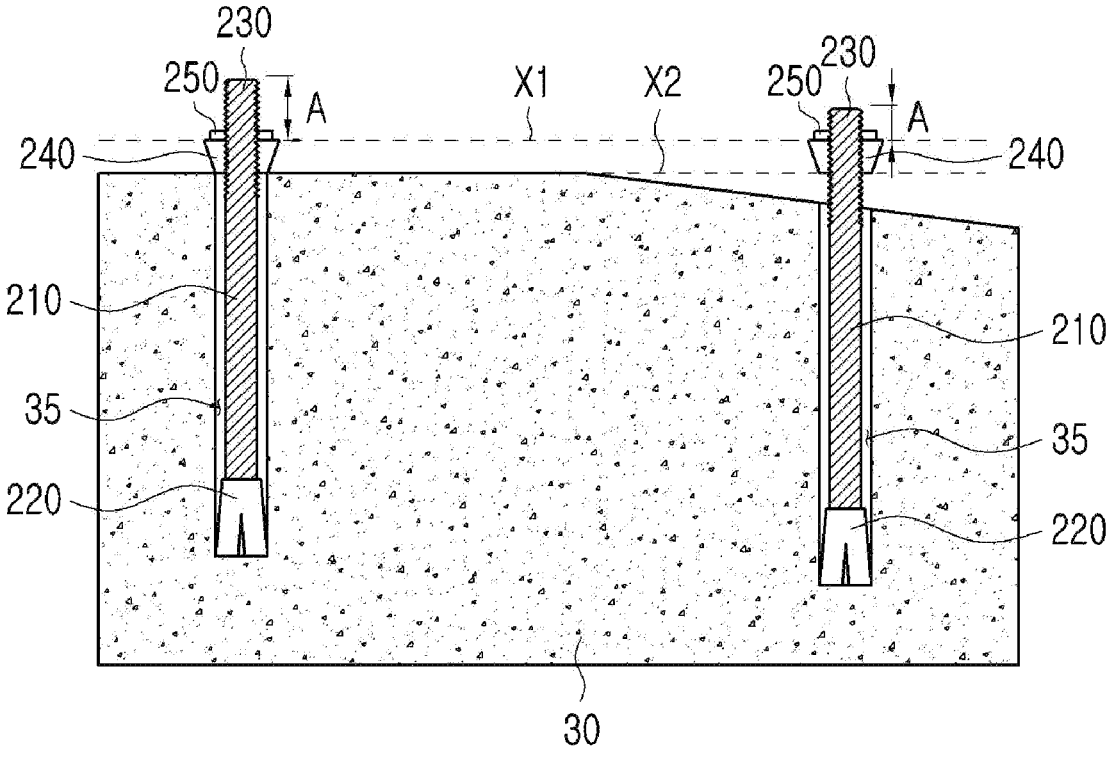
FIGS. 6 and 7 are cross-sectional views illustrating wooden vertical beams and a concrete foundation coupled to one another according to the method of the present disclosure.

Next, the post-installed anchor 200 is installed in each of the anchor holes 35 (operation S520). When the post-installed anchor 200 is inserted into each anchor hole 35, the sleeve 220 expands in an insertion process, and the post-installed anchor 200 is securely fixed into the anchor hole 35. The anchor head 230 protrudes from an upper side of an upper surface of the concrete foundation 30. This state is shown in FIG. 6. Since this state is before horizontal leveling of the concrete foundation 30, when viewed from the outside, heights of the uppers surface of the anchor head 230 may not coincide with each other, as shown in FIG. 6.

Next, the nut 240 is coupled to the anchor head 230 of each post-installed anchor 200 (operation S530). In this case, the coupling depth of the nut 240 is adjusted. That is, a long level is placed on upper surfaces of the nuts 240, and the nuts 240 are coupled to the anchor head 230 so that the upper surfaces of the nuts 240 may coincide with the same reference surface X1 while looking at the level. Thus, some nuts 240 may be in contact with the concrete foundation 30 (left side of FIG. 6), and some nuts 240 may not be in contact with the concrete foundation 30 (right side of FIG. 6).

Next, a portion A of the anchor head 230 protruding from an upper side of the upper surface of the nut 240 is cut (operation S540). In a predetermined embodiment, operation S540 may be omitted.

Next, n wooden vertical beams 10 having lower surfaces in which the insertion holes into which the nuts 240 are inserted, are formed, are prepared. In a predetermined embodiment, a long anchor head hole (not shown) may be further formed in a vertical direction in which the anchor head 230 is inserted into the wooden vertical beams 10.

Next, the wooden vertical beams 10 are moved in a predetermined movement direction so that the wooden vertical beams 10 and the post-installed anchor 200 are combined with each other (operation S550). That is, the wooden vertical beams 10 are moved in a horizontal direction and are installed so that the nut 240 may be inserted into the insertion hole formed in a lower surface of each of n wooden vertical beams 10.

In this case, the movement direction of n wooden vertical beams 10 is preferably two or more. That is, it is preferable that the movement direction of each of n wooden vertical beams 10 is one of two or more movements. In this way, the direction of the wooden vertical beams 10 is changed so that, when an external force is applied in one direction due to an earthquake etc., all wooden vertical beams 10 may be prevented from being deviated from the post-installed anchor 200.

Referring back to FIGS. 1 and 2, an example will be described assuming that four wooden vertical beams 10 are used. In this case, n is 4, and four movement directions are perpendicular to each other on a horizontal plane.

Specifically, a first wooden beam 11 has an insertion hole open in a first direction and is combined with the post-installed anchor 200 in the first direction. The first direction is a direction parallel to the ground and is a direction toward the inside of the concrete foundation 30. Similarly, the second wooden beam 12 has an insertion hole open in a second direction and is combined with the post-installed anchor 200 in the second direction. The second direction is a direction parallel to the ground, is a direction toward the inside of the concrete foundation 30 and is a direction perpendicular to the first direction. The third wooden vertical beam 13 has an insertion hole open in a third direction and is combined with the post-installed anchor 200 in the third direction. The third direction is parallel to the first direction and opposite to the first direction. A fourth wooden vertical beam 14 has an insertion hole open in a fourth direction and is combined with the post-installed anchor 200 in the fourth direction. The fourth direction is parallel to the second direction and opposite to the second direction. Thus, each of the first through fourth wooden vertical beams 11, 12, 13, and 14 is combined with each of the plurality of post-installed anchors 200 in different directions. Thus, the sum of stresses of wooden vertical beams arranged diagonally to each other may be 0. When a load due to a roof, etc. occurs in a state in which all wooden vertical beams 11, 12, 13, and 14 are combined with the concrete foundation 30, the first wooden vertical beam 11 receives a pressing force in the first direction, and thus, stress is formed in the opposite direction to the first direction. Simultaneously, the third wooden vertical beam 13 receives a pressing force in the third direction, and accordingly, stress is formed in the opposite direction to the third direction. That is, the sum of stresses formed by the first wooden vertical beam 11 and the third wooden vertical beam 13 is 0. Thus, by means of the first wooden vertical beam 11 and the third wooden vertical beam 13, forces may be balanced about an axis parallel to the first direction. In the same principle, the sum of stresses formed by the second wooden vertical beam 12 and the fourth wooden vertical beam 14 may be 0. Thus, forces may be balanced about an axis parallel to the second direction. Thus, the sum of forces for all axes is 0 so that the wooden building may support the load of the building stably without tilting in one direction.

Figure 7:
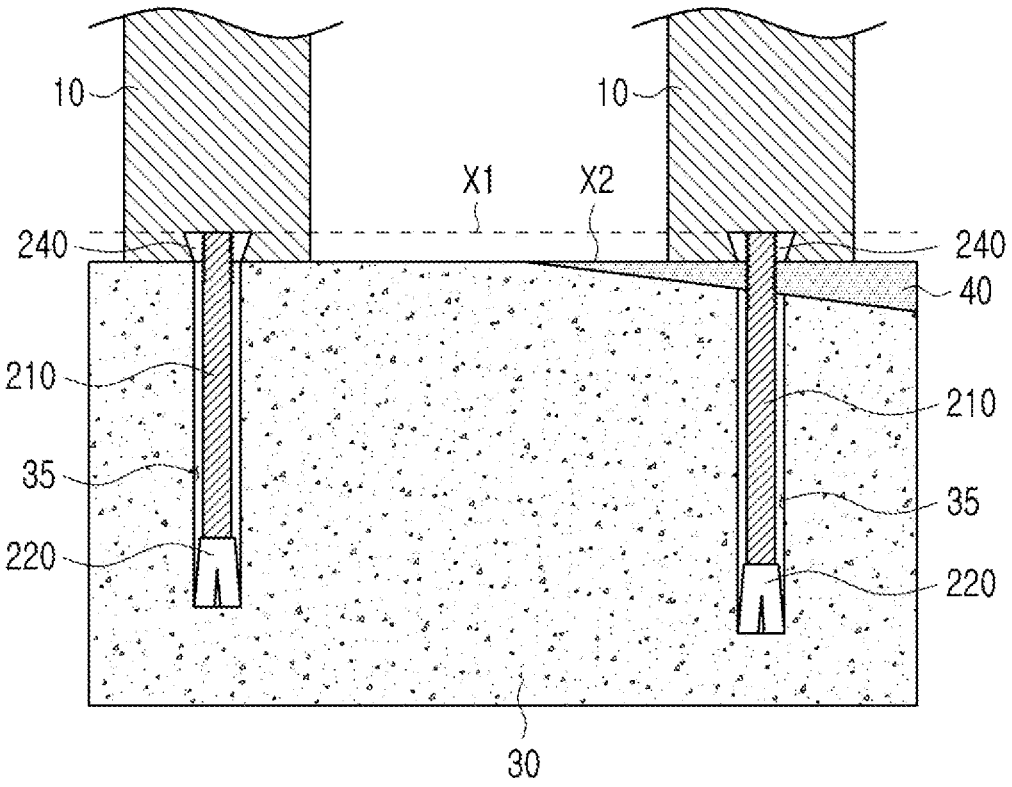

When coupling between the wooden vertical beams 10 is completed in this manner, it may be determined whether the wooden vertical beams 10 are in contact with the concrete foundation 30 depending on whether the nut 240 and the concrete foundation 30 are in contact with each other. As shown in FIG. 7, some wooden vertical beams 10 may be in contact with the concrete foundation 30 (left side of FIG. 7), and some wooden vertical beams 10 may not be in contact with the concrete foundation 30 (right side of FIG. 7).

Thus, when there is a space in lower portions of the wooden vertical beams 10 where a space is created without contact, in other words, there is a space between lower surfaces of the concrete foundation 30 and the nut 240, the space is filled with non-shrinking mortar (operation S560). At this time, a worker may pour a material based on the lower surfaces of the wooden vertical beams 10. Easy pouring is possible, similar to pouring concrete in an RC building using a reinforcing bar with marked levels. When there are several tens to hundreds of wooden vertical beams 10, from the worker's point of view, after finding only the wooden vertical beams 10 whose lower surfaces do not contact the upper surface of the concrete foundation 30, horizontal leveling is completed only by pouring non-shrinking mortar to fill the space below by referring to the lower surfaces of the wooden vertical beams 10. Thus, when non-shrinking mortar is poured and cured, the horizontal surface of the concrete foundation 30 is naturally completed as a foundation horizontal surface X2, as shown in FIG. 7.

Description of a Second Embodiment

A second embodiment of the present disclosure is a scheme for utilizing an iron bracket 260 so as to couple the wooden vertical beams 10 more strongly, and will be described with reference to FIGS. 8 and 9. A description of a portion corresponding to the first embodiment will be omitted.

Figure 8:
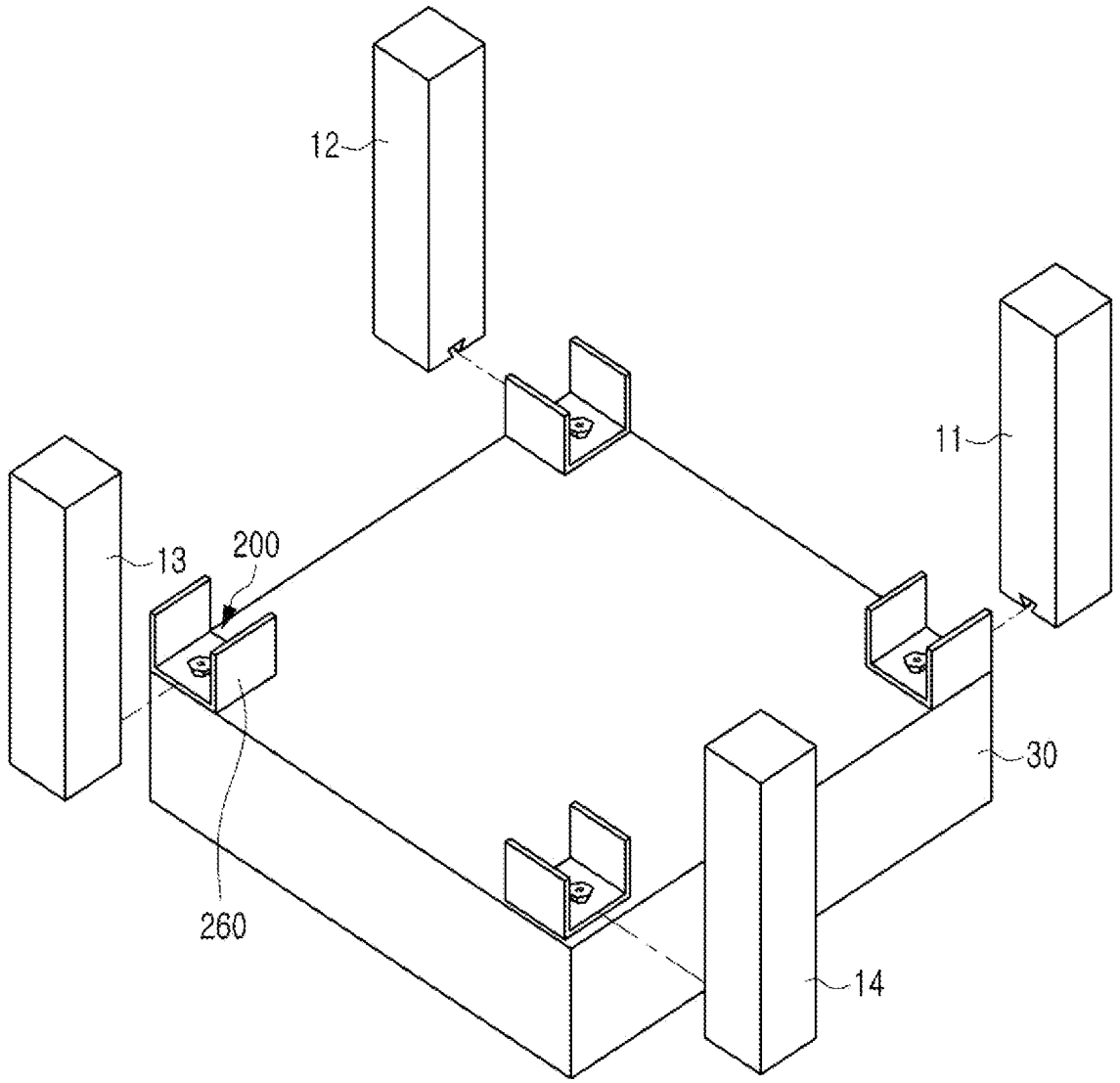
FIG. 8 illustrates wooden vertical beams and a concrete foundation coupled to each other according to a second embodiment of the present disclosure.
Figure 9:
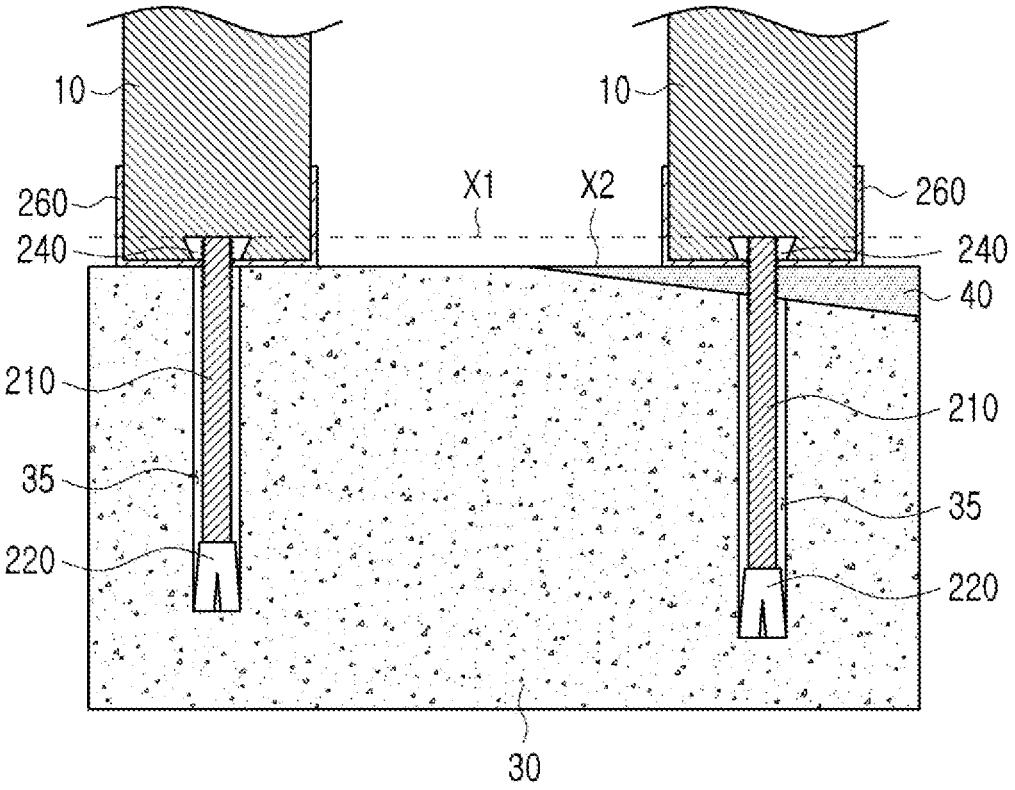
FIG. 9 illustrates wooden vertical beams and a concrete foundation coupled to one another according to a second embodiment of the present disclosure.

The bracket 260 surrounds the lower surfaces of the wooden vertical beams 10 and may have a ¬ shape, and alternatively, as shown in FIGS. 8 and 9, may have a [ shape. Thus, when force in the horizontal direction is applied to the bracket 260, the bracket 260 may deliver the force in the horizontal direction to the concrete foundation 30 more smoothly.

The bracket 260 is installed between the nut 240 and the concrete foundation 30 so that the anchor head 230 passes through the bracket 260. To this end, holes having sizes equal to or greater than the size of the anchor hole 35 are formed in the lower surface of the bracket 260.

Figure 5:
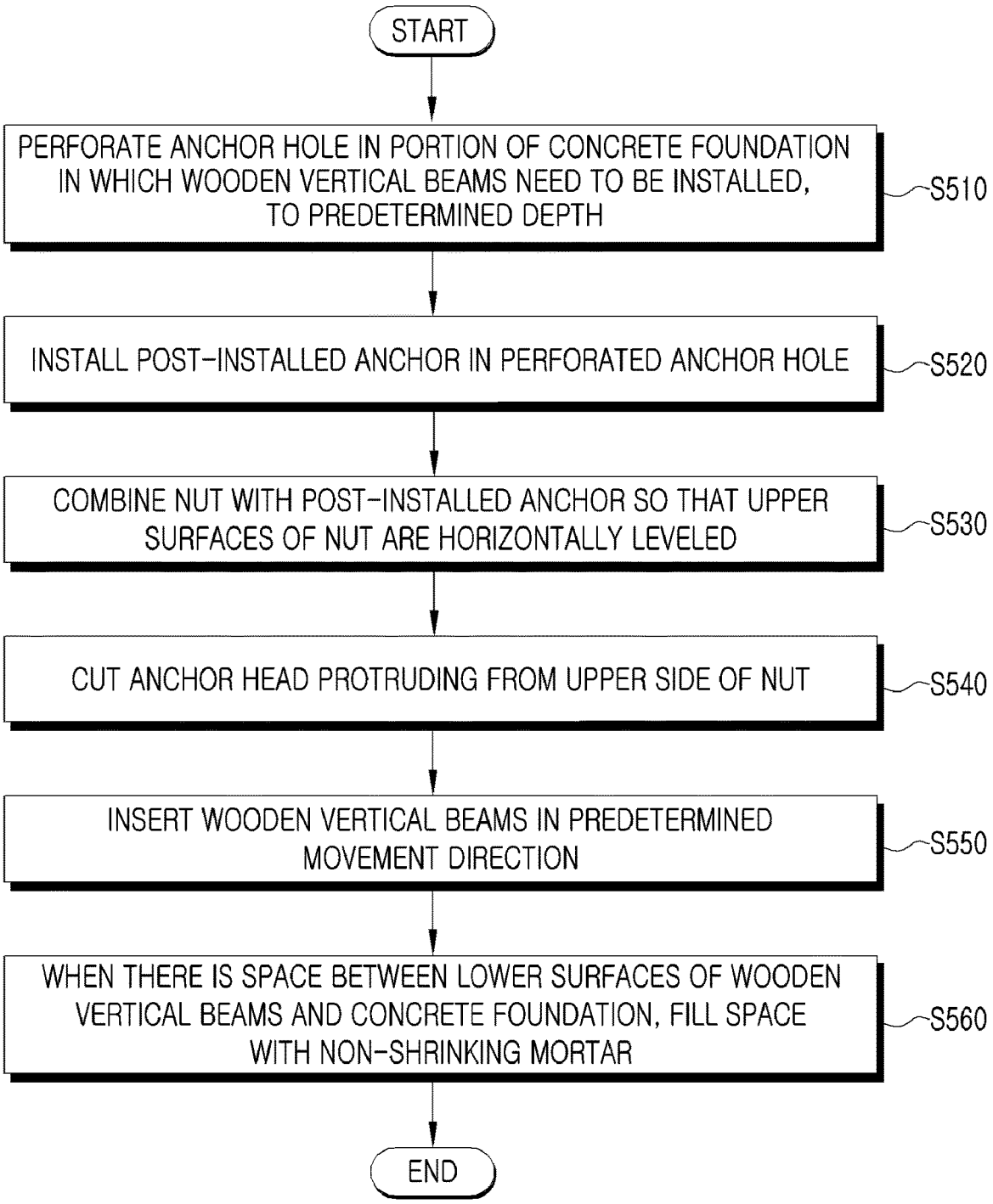
FIG. 5 is a flowchart illustrating the method of the present disclosure.

In the method according to the second embodiment, after operation S510 of FIG. 5, the method further includes placing the bracket 260 in an upper portion of each of the anchor holes 35 so that the hole of the bracket 260 may be placed in the upper portion of each of the anchor holes 35.

The installation direction of the bracket 260 is determined to be open in a corresponding direction naturally in consideration of the movement direction of the wooden vertical beams 10. For example, in the embodiment described with reference to FIGS. 1 and 2, the bracket 260 installed in the first wooden vertical beam 11 is placed to be open in the first direction in consideration of the movement direction of the first wooden vertical beam 11. The bracket 260 installed in each of the second through fourth wooden vertical beams 12, 13, and 14 also considers the movement direction of the corresponding wooden vertical beam.

Description of a Third Embodiment

Figure 10:
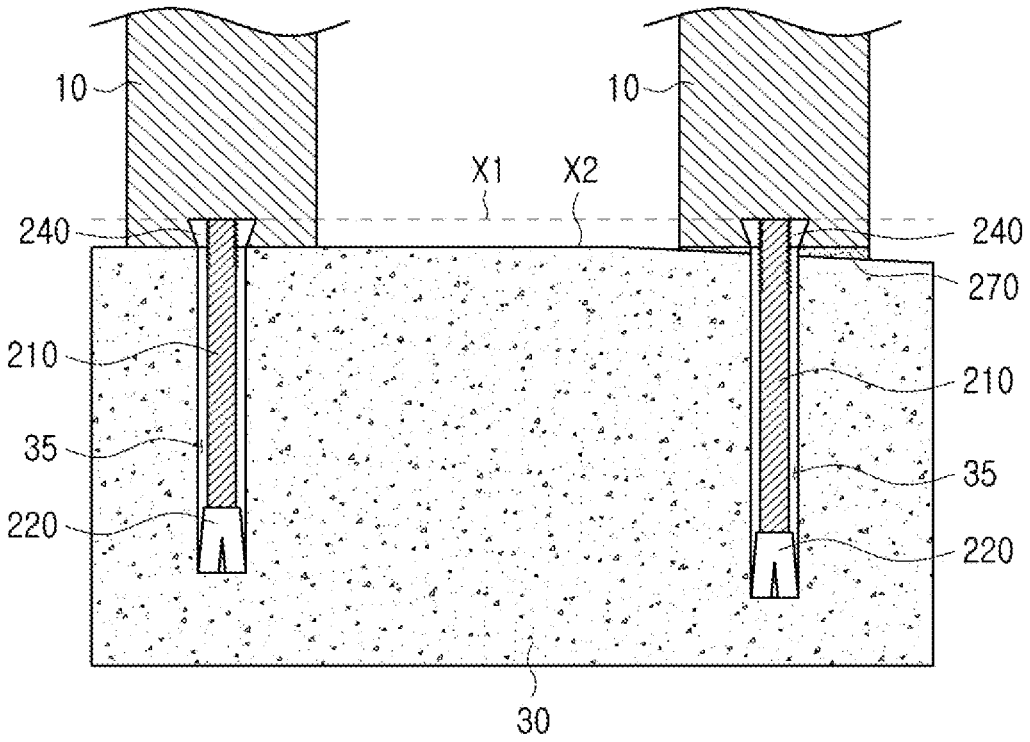
FIG. 10 illustrates wooden vertical beams and a concrete foundation coupled to one another according to a third embodiment of the present disclosure.

A third embodiment of the present disclosure is a dry construction method that does not use non-shrinking mortar, and will be described with reference to FIG. 10. A description of a portion corresponding to the first embodiment will be described.

In the third embodiment, operations S510 to S550 of FIG. 5 are the same as in the first and second embodiments, and in operation S560, a material for filling the space between the lower surfaces of the concrete foundation 30 and the nut 240 is different from a material in the first and second embodiments. When the corresponding space is not large, i.e., the poured and cured state of the concrete foundation 30 is good and thus a horizontal leveling work is not large, a wedge-shaped wooden washer plate 270 may be used without using non-shrinking mortar.

In the third embodiment, after installation of the wooden vertical beams 10 is completed, when the space between the lower surfaces of the concrete foundation 30 and the nut 240 is not large, the wedge-shaped wooden washer plate 270 manufactured with an appropriate thickness is inserted into the corresponding space without pouring non-shrinking mortar. Since the wooden washer plate 270 has a wedge shape, site insertion into the corresponding space is possible, and this is because the wood itself can sufficiently resist an axial force (i.e., an upper load).

The above description is merely an illustrative explanation of the technical idea of the present embodiment, and those skilled in the art will be able to make various modifications and variations without departing from the essential characteristics of the present embodiment. Accordingly, the present embodiments are not intended to limit the technical idea of the present embodiment, but rather to explain it, and the scope of the technical idea of the present embodiment is not limited by these examples. The scope of protection of the present embodiment should be interpreted in accordance with the claims below, and all technical ideas within the equivalent scope should be interpreted as being included in the scope of rights of the present embodiment.

The invention claimed is:

1. A method for horizontal leveling coupling between a concrete foundation and wooden vertical beams, comprising:

(a) perforating n anchor holes in a predetermined position of the concrete foundation, where n is a natural number that is greater than or equal to 2;

(b) installing a post-installed anchor in each of the n anchor holes;

(c) coupling each of nuts to each thread-shaped anchor head located on an upper portion of the post-installed anchor, wherein the nuts are coupled so that upper surfaces of the nuts coincide with a reference surface X1;

(d) preparing the wooden vertical beams having lower surfaces in which insertion holes into which the nuts are inserted, are formed;

(e) installing the wooden vertical beams by moving the wooden vertical beams in a horizontal direction so that the nuts are inserted into the insertion holes formed in the lower surfaces of the wooden vertical beams, wherein a movement direction of each of the wooden vertical beams is one among two or more movement directions; and (f) filling a space between lower surfaces of the concrete foundation and the nuts with a predetermined member.

2. The method of claim 1, wherein (f) comprises (f1) filling a space between lower surfaces of the concrete foundation and the nuts with non-shrinking mortar.

3. The method of claim 1, wherein (f) further comprises (f2) filling a space between lower surfaces of the concrete foundation and the nuts with a wedge-shaped wooden washer plate.

4. The method of claim 1, further comprising:

after (c), (c1) cutting a portion A of the anchor head protruding from upper sides of the upper surfaces of the nuts 240.

5. The method of claim 1, wherein the nuts further comprise an epoxy bag at upper sides of the nuts, and wherein (e) comprises (e1) installing the wooden vertical beams by moving the wooden vertical beams in the horizontal direction so that the nuts are inserted into the insertion holes formed in the lower surfaces of the wooden vertical beams, wherein the epoxy bag is unfolded and the insertion hole is filled with epoxy.

6. The method of claim 5, further comprising:

after (e1), (e2) filling the insertion hole with epoxy when the epoxy bag is unfolded and further filling a space between the anchor hole and the post-installed anchor when the remaining epoxy descends along an anchor body of the post-installed anchor.

7. The method of claim 1, further comprising:

after (b), (b1) preparing brackets having ¬-shapes or [-shapes with lower surfaces in which holes having sizes that are greater than or equal to the n anchor holes are formed, and placing the brackets on an upper portion of each of the n anchor holes so that the holes of the brackets are placed in an upper portion of the anchor hole.

8. The method of claim 1, wherein the nuts have hexagonal pyramid shapes and tapered shapes with widths decreasing downwards.

9. The method of claim 8, wherein the insertion holes of the wooden vertical beams have tapered trapezoidal shapes with widths decreasing downwards.

10. The method of claim 1, wherein a number of movement directions in which the wooden vertical beams are installed, is four, and the four movement directions are perpendicular to one another on a horizontal plane.

* * * * *